US007300226B1

(12) United States Patent
Maestro

(10) Patent No.: US 7,300,226 B1
(45) **Date of Patent: *Nov. 27, 2007**

(54) STORMWATER RECEIVING ASSEMBLY

(76) Inventor: Robert M. Maestro, 12301 Beechnut Ct., Woodbridge, VA (US) 22192-2002

( * ) Notice: Subject to any disclaimer, the term of this patent is extended or adjusted under 35 U.S.C. 154(b) by 32 days.

This patent is subject to a terminal disclaimer.

(21) Appl. No.: 11/396,004

(22) Filed: Apr. 3, 2006

Related U.S. Application Data

(60) Provisional application No. 60/669,433, filed on Apr. 9, 2005.

(51) Int. Cl.
*E02B 11/00* (2006.01)
*E02B 13/00* (2006.01)

(52) U.S. Cl. ..... 405/46; 405/49; 405/43

(58) Field of Classification Search ..... 405/36, 405/39–49, 51

See application file for complete search history.

(56) References Cited

U.S. PATENT DOCUMENTS 6,612,777 B2 * 9/2003 Maestro ..... 405/49
6,719,490 B2 * 4/2004 Maestro ..... 405/46
6,994,490 B2 2/2006 Maestro

* cited by examiner

*Primary Examiner*—Frederick L. Lagman
(74) *Attorney, Agent, or Firm*—Norman B. Rainer

(57) ABSTRACT

An assembly for receiving and diffusing stormwater in underground installations includes a horizontally elongated plastic chamber having an arched cross-sectional shape with an upwardly directed apex having an inlet portal. A sediment-accumulating compartment is positioned below the chamber in vertical alignment with the portal. A rigid riser pipe of circular cylindrical configuration penetrates the portal and extends vertically between a bottom extremity located within the chamber and a top extremity positioned substantially at ground level in association with a grated street-level stormwater receiving structure.

9 Claims, 6 Drawing Sheets

STORMWATER RECEIVING ASSEMBLY

RELATED APPLICATIONS

This application is based upon Provisional Application 60/669,433 filed on Apr. 9, 2005.

BACKGROUND OF THE INVENTION

1. Field of the Invention

The present invention relates to the management of stormwater runoff, and more particularly concerns devices which minimize and facilitate sediment maintenance, expand the storage capacity of stormwater management systems, and facilitate the infiltration of stormwater into the surrounding substrate.

2. Description of the Prior Art

Culverts, catch basins, and storm sewers are the common practices for collecting and conveying stormwater runoff. In some instances such water is discharged directly into the nearest available water body despite the potentially adverse environmental effects of such action. In some other instances, stormwater management facilities are constructed to help manage the quantity and quality of the stormwater. Wet or dry retention or detention basins/ponds represent the most common structural approach to stormwater management. Although more environmentally sound than direct discharge into an existing water body, such stormwater management approaches preclude other uses of the land. This is of particular importance where land values are high and/or space is limited. The open ponds may also be undesirable in locations near airports because of birds attracted by the pond, or in locations where health, liability or aesthetic considerations make them undesirable. Even the use of "dry" detention basins frequently results in the same types of problems associated with wet ponds. Without proper maintenance, dry detention basins frequently transform into wet ponds.

Underground systems have also been developed to help manage stormwater effluent. Such systems include the use of plastic arch-shaped, open bottom chambers arranged end-to-end in rows. However, all current underground stormwater management systems are limited by the amount of area available for their installation. This is particularly relevant to the plastic stormwater chambers. Although maximum size of the chamber is desirable, the strength of the chamber with respect to crushing by the overlying substrate generally diminishes with increased chamber size.

In a typical installation of plastic stormwater chambers, elongated hollow plastic chambers are emplaced in the ground to form a leaching field for receiving stormwater and dispensing the water into the surrounding earth. Such chambers have a central cavity for receiving inflow water. An open bottom, and apertures optionally located in the sides of the chambers provide the means whereby the water is allowed to exit the central cavity and disperse into the surrounding earth. The chambers are usually attached endwise to form long rows extending in side-by-side juxtaposition and seated upon a crushed rock substrate in a multi-row array that constitutes a leaching field. The stormwater is generally conducted to the array of rows by a large diameter header manifolded pipe system that runs orthogonally to the rows closely adjacent one extremity thereof.

Examples of stormwater dispensing chambers are disclosed in U.S. Pat. Nos. 5,017,041; 5,156,488; 5,336,017; 5,401,116; 5,441,363; 5,556,231 and 6,361,248.

Stormwater typically carries considerable amounts of suspended particulate material, commonly referred to as Total Suspended Solids (TSS), which eventually settles out as sediment within the stormwater management system. The accumulation of such sediment adversely affects the storage capacity of stormwater management facilities, decreasing their effective life. The effective life of such facilities can be significantly extended with a maintenance program for sediment removal. By virtue of the present invention, sediment removal can be achieved by a vacuuming operation conducted by a suitably equipped truck. In such operation, a tube is extended from the truck through a surface access structure, through an associated riser pipe, and into the bottom of the chamber. The sediment in the bottom of the chamber is then removed by vacuuming.

Unfortunately, the maintenance of stormwater management systems is typically neglected, causing sediment to accumulate to a point where flooding occurs because of diminished storage capacity of the system. This problem has become so serious that some municipalities have imposed a stormwater maintenance "fee" on property owners to help pay for private-sector stormwater facility maintenance.

Unlike stormwater wet and dry ponds, which are readily observable and accessible, removal of sediment from underground stormwater management facilities has historically been inherently more inconvenient and costly, resulting in resistance to their use by some municipalities. Some types of underground stormwater management facilities even have to be replaced in order to remove accumulated sediment.

U.S. Pat. No. 6,719,490 to Maestro discloses a stormwater receiving assembly wherein a box-like compartment for accumulating sediment is disposed beneath a plastic dispensing chamber having an arched wall configuration. A top portal is disposed in the apex of the arch directly above the compartment to facilitate joinder to a "riser" access pipe which extends upwardly to a surface access structure such as a manhole at surface ground level. Said riser pipe is generally constructed of rigid polyvinylchloride (PVC) having an inside diameter of 10 inches, which permits passage of a vacuuming tube, generally of 8 inch outside diameter.

Although such sediment-accumulating compartment provides effective results, it is found that because the vacuuming tube must extend further downward a distance of 3-5 feet to reach the sediment, an extra length of the tube must be added onto the customarily employed length of tube. The usual technique for adding a length of tube involves an external coupling device which increases the effective outside diameter of the tube. This, in turn, requires that the riser pipe and top portal must have a larger diameter. However, it has generally been found that enlargement of the top portal diminishes the load-bearing strength of the chamber.

In earlier described installations of the aforesaid underground leaching fields, above ground means are employed for collecting or channeling stormwater which is fed to an underground large diameter manifold pipe system that directs the stormwater to the inlet extremities of the first chambers of each row of chambers. It would be desirable to have greater versatility in the routing of stormwater to the underground leaching field, particularly by making use of conventional street-level grated stormwater receptacles, whose water-collecting capacities are generally rated greater than a conduit of 10 inch diameter.

It is accordingly an object of the present invention to provide a plastic stormwater dispensing chamber of arched configuration capable of receiving a large diameter riser pipe with minimal loss of chamber strength.

It is a further object of this invention to provide an underground stormwater receiving assembly capable of receiving stormwater from street-level grated receptacles.

It is another object of the present invention to provide structural modifications in the chamber to strengthen the chamber to accommodate an enlarged top portal.

These objects and other objects and advantages of the invention will be apparent from the following description.

SUMMARY OF THE INVENTION

The above and other beneficial objects and advantages are accomplished in accordance with the present invention by a stormwater receiving assembly comprised of a stormwater dispensing chamber adapted for underground installation and comprised of a plastic wall horizontally elongated between inlet and exit ends and having an arched cross-sectional shape with upwardly directed apex and spaced apart parallel lowermost edge extremities defining an open bottom, said wall having clean out portal means in said apex. Said portal means has an effective circular diameter between 10 and 14 inches and is defined by a perimeter which in part extends downwardly from said apex, the maximum distance of said downward extension being less than 25% of said effective diameter.

An accumulating accessory comprised of a compartment bounded by sidewall structure elongated between a lower extremity and an open upper extremity is positioned below said dispensing chamber in a manner such that said portal means is in centered vertical alignment with the lower extremity of said compartment.

A rigid riser pipe of circular cylindrical contour penetrates said portal means and extends vertically between said chamber and ground level.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
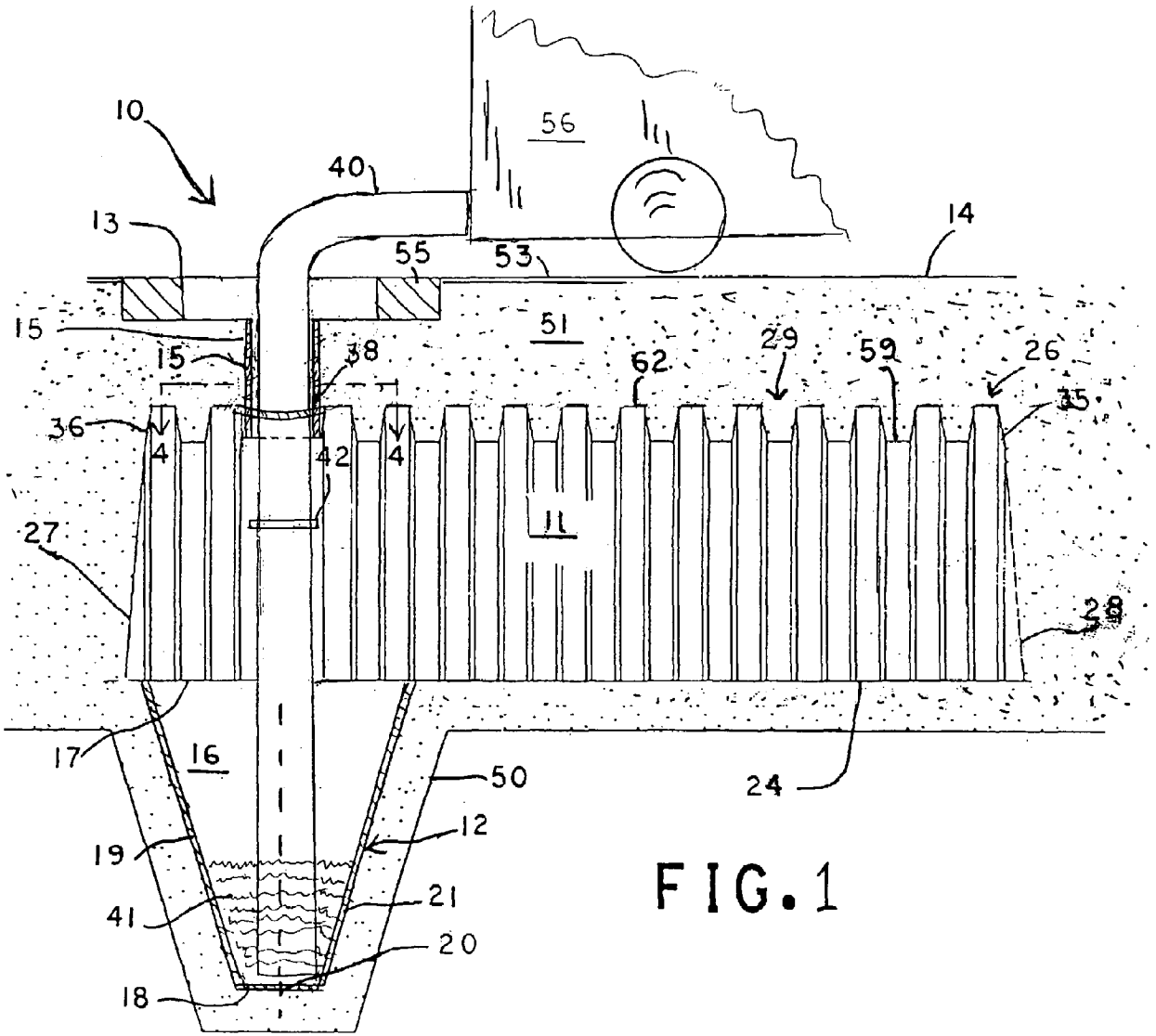
FIG. 1 is a side view, partly in section, of an embodiment of the stormwater receiving assembly of the present invention.

Referring now to FIGS. 1-6, an embodiment of the stormwater receiving assembly 10 of this invention is shown comprised of dispensing chamber 11, an accumulating accessory 12 positioned below said chamber, a structural fitting such as a conventional street-level grated stormwater receptacle 13 positioned at ground level 14, and riser pipe 15 which descends vertically to chamber 11 from fitting 13. The accumulating accessory is comprised of a compartment 16 having an open upper extremity 17 and lower extremity 18 which may be closed or bounded by a perforated panel. Said compartment is further defined by sidewall structure 19 which is preferably downwardly convergent upon center vertical axis 20, thereby causing sediment to accumulate upon said lower extremity rather than upon the interior surfaces of the sidewall structure. The accumulating accessory may be a monolithic structure fabricated of polyethylene, polypropylene or equivalent thermoplastic polymer having a wall thickness between 2 and 6 mm and a height between 20 and 72 inches.

In the exemplified embodiment, said sidewall structure is comprised of four flat panels 21 disposed in an inverted pyramidal configuration, causing upper extremity 17 to have a rectangular perimeter 22. In alternative embodiments, sidewall structure 19 may be of circular cylindrical or other configurations. Anchoring appendages may extend outwardly from said sidewall structure to provide in-ground stabilization of the accessory. Such appendages are disclosed in U.S. Pat. No. 6,994,490 which is incorporated herein by reference. Flat apron panels 23, may be directed outwardly from said compartment within the plane of perimeter 22. Retaining lips 65 may be associated with said apron panels to engage the interior surface of the associated chamber 11 adjacent its lowermost edge 24, thereby stabilizing the interaction of the chamber with the underlying accumulating accessory. Alignment means, which may be in the form of indicia 25 on apron panels 23 and chamber 11, facilitate axial alignment of the chamber with respect to accessory 12. Sidewall structure 19 may be provided with a multitude of apertures which facilitate drainage of water from said compartment.

Chamber 11 is comprised of a wall 26 extending upon a longitudinal axis between inlet and exit ends, 27 and 28, respectively, and having an arch shape cross-section with an upwardly directed apex 29, and opposed lowermost spaced apart parallel edges 24 which define an open bottom 30. Wall 26 has a multiplicity of corrugations 31 comprised of alternating peaks and valleys 62 and 59, respectively, disposed in planes orthogonal to edges 24, thereby imparting increased compressive strength to said wall. Chambers useful in the practice of the present invention are fabricated of thermoplastics by way of thermal vacuum forming or gas assisted injection molding techniques, generally in accord with the technology described in U.S. Pat. Nos. 5,401,459; 5,087,151; 4,247,515; 4,234,642; 4,136,220 and 4,101,617, the disclosures of which are hereby incorporated by reference.

The chamber preferably has opposed axially elongated base panels 34 integral with edges 24 of wall 26. Said base panels support the chamber, discouraging its descent into the underlying substrate, and rest upon apron panels 23 of said accumulating accessory.

The terminal corrugation 36 adjacent exit end 27 may be slightly larger than the multitude of ribs, and terminal rib 35 adjacent inlet end 28 is slightly smaller than the multitude of ribs. Such configuration of the terminal ribs facilitates end-to-end joinder of successive chambers wherein vertical lowering of a chamber automatically causes the larger rib of one chamber to embrace the smaller rib of the next successive chamber in the resultant row. Typical chambers of this invention may have a length of 6-12 feet measured between inlet and exit ends.

Figure 3:
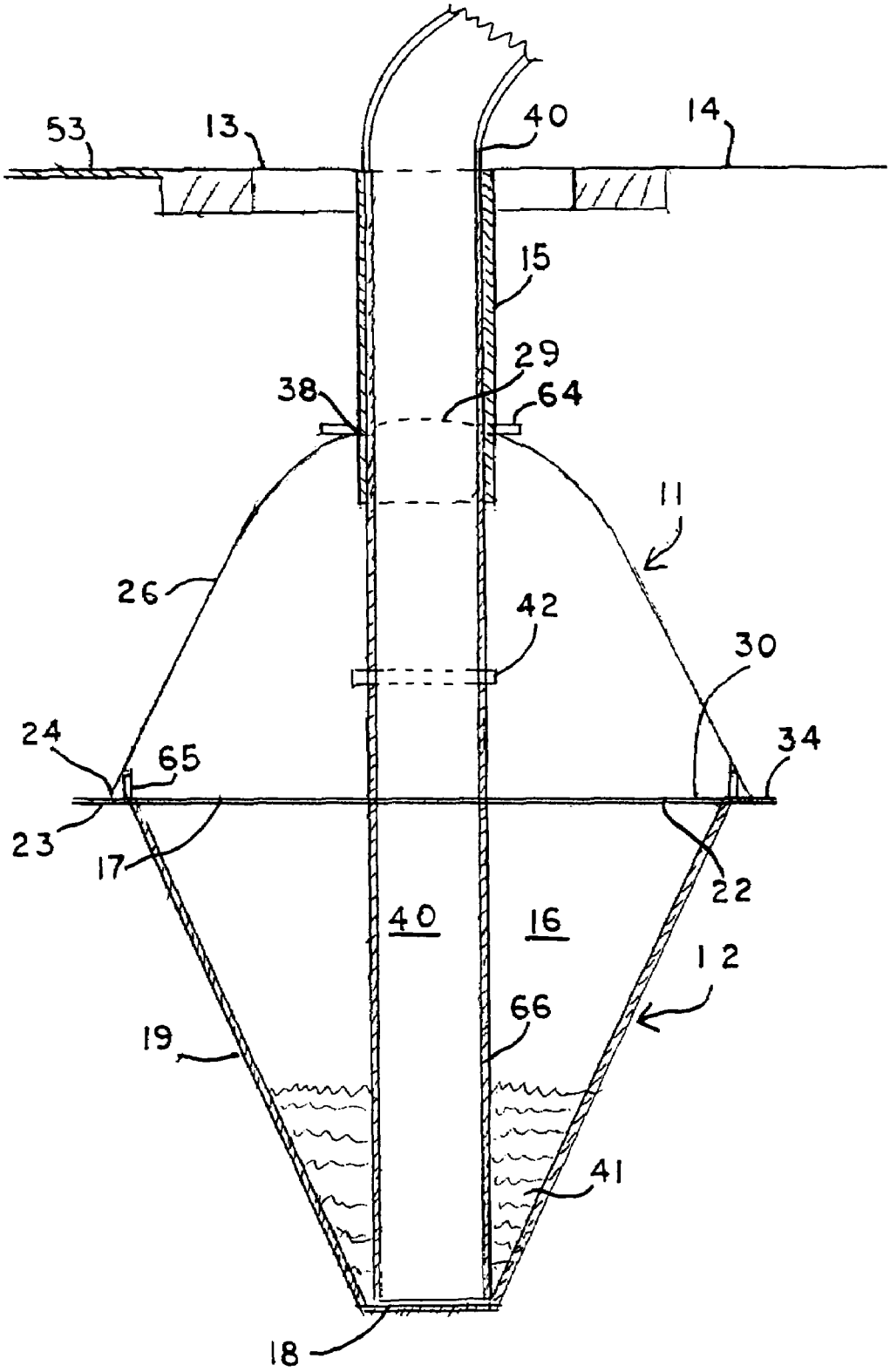
FIG. 3 is a schematic end view taken from the left of FIG. 1.
Figure 5:
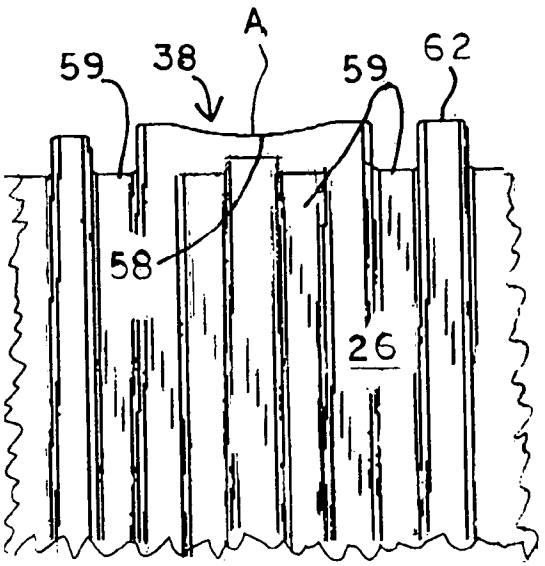
FIG. 5 is an enlarged fragmentary side view of the embodiment of FIG. 1.
Figure 4:
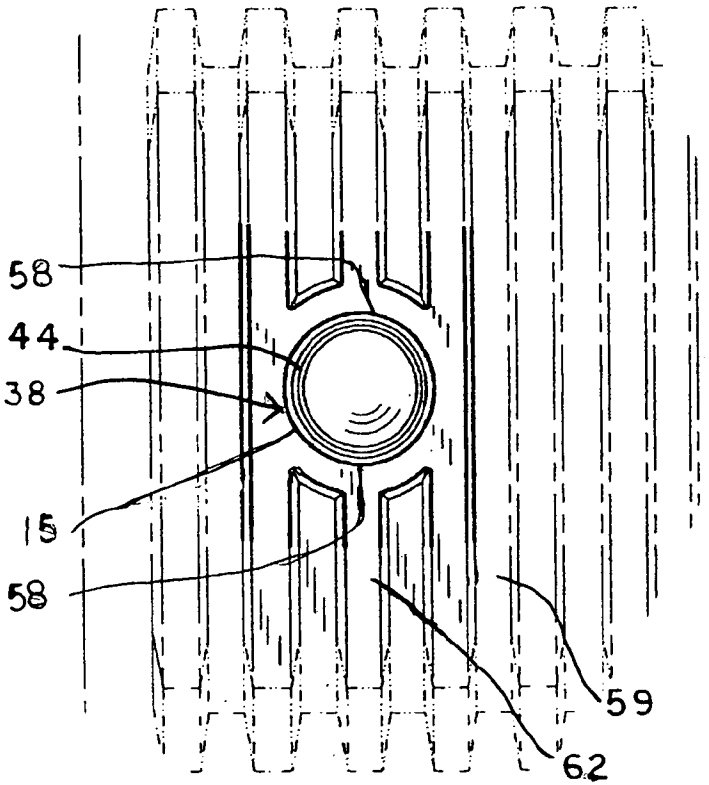
FIG. 4 is an enlarged fragmentary top view taken in the direction of the arrows upon line 4-4 of FIG. 1.

Portal means 38 is centered in the apex of wall 26 adjacent exit end 27. Said portal means is either a substantially circular aperture or an indented or otherwise marked portion of the wall which facilitates the cutting of a circular aperture. Said portal means permits visual observation of sediment level and removal thereof by vacuum equipment. The aforesaid expression "adjacent exit end 27" is intended to denote a site along the horizontal length of the chamber which is within 20% of the distance going from said exit end toward the opposed inlet end. The diameter of said portal means is preferably between 10 and 14 inches. Said diameter should be of adequate size to accommodate a riser pipe is of circular cylindrical contour having an outside diameter of 11 to 14 inches, and an inside diameter of 10 to 13.5 inches. Such dimensional configuration enables the chamber to receive stormwater directly from an overhead street level structural fitting 13 in the form of a conventional curbside grated stormwater receptacle. Said fitting 13 may alternatively be a street level manhole cover. The exceptionally large size of the portal means permits insertion of a vacuuming tube 40, generally of 8 inch inside diameter, through riser pipe 15 and to the lower extremity 18 of the accumulating accessory, permitting removal of accumulated sediment 41. As shown in FIGS. 1 and 3, such passage of tube 40 is accommodated even with coupling 42 extending outwardly from tube 40, said coupling generally being necessary to add a lower extension section 66 on to tube 40. Said extension section may need to be of 3-6 foot length to reach lower extremity 18 of compartment 16.

In order for portal means 38 to have a diameter in the range of 10-14 inches, certain conditions have to be met in order to preserve the compressive strength of the chamber. In particular, the width of the chamber must be in the range of 50 to 60 inches, the height of the chamber must be between 34 and 40 inches, and the wall thickness adjacent the top portal must be between 6 and 10 mm. The configuration of the arched cross-sectional shape of the chamber should be a modified parabola. With such criteria of structure, the perimeter 44 of the portal means will, in its lateral portions 58 extend downwardly from apex 29 to site A, shown in FIG. 5, by a distance no greater than 25% of the circular diameter of the portal. It is also necessary that site A be above contiguous valleys 59. Said downward extension of the portal perimeter is a consequence of the curvature of the chamber wall. Exit end 27 of exemplified chamber 11 is closed by way of panel 47. However, the inlet and exit ends of subsequent chambers interconnected in a row are open to permit longitudinal flow of water.

Figure 2:
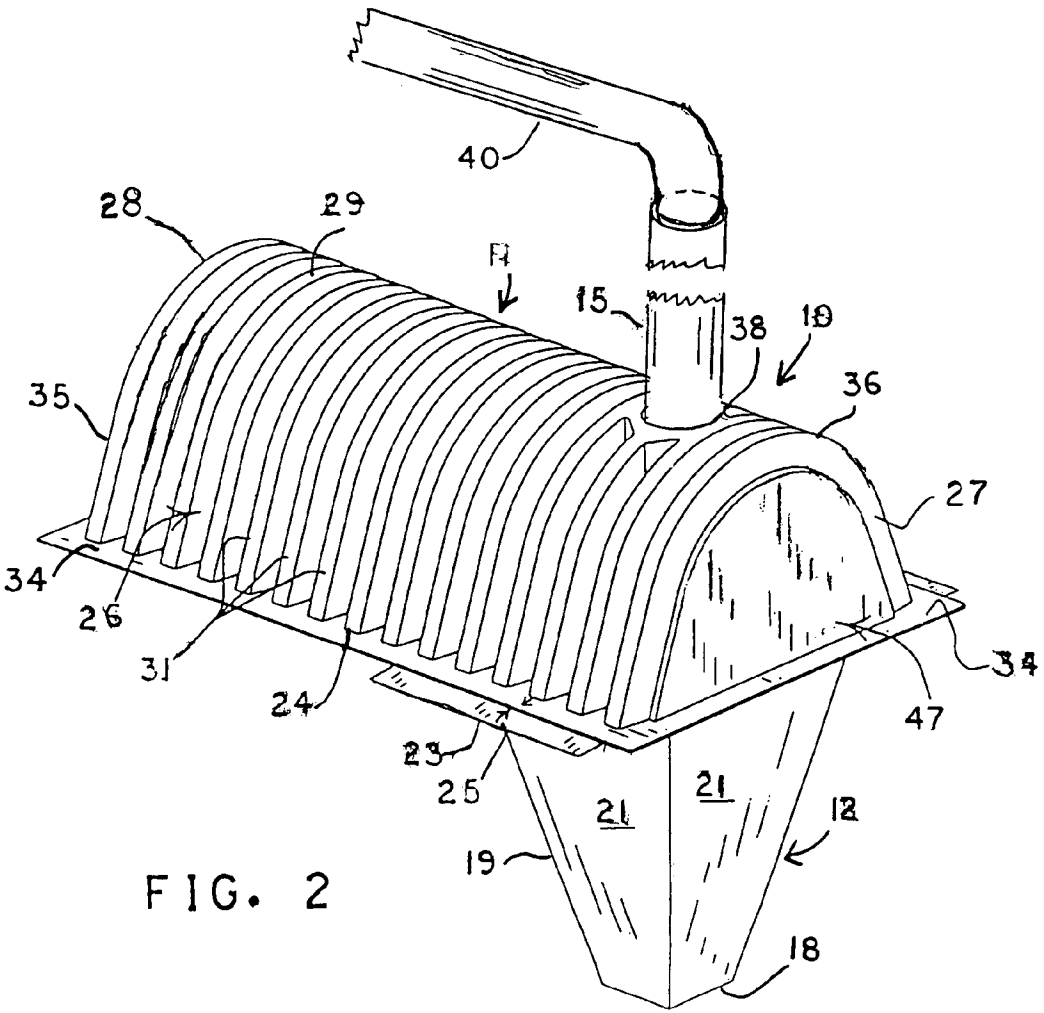
FIG. 2 is a side perspective view of the embodiment of FIG. 1.

Accumulating accessory 12 is preferably associated with chamber 11 as shown in FIGS. 1-3, wherein said chamber is positioned atop the accumulating accessory in a manner whereby base panels 34 of the chamber are caused to rest upon said accessory. It is to be further noted that the accessory is positioned such that its vertical axis 20 intersects the center of top portal means 38.

As shown in FIG. 1, the combined chamber and accumulating accessory of this invention is installed in an excavation upon a porous subterranean substrate such as crushed rock 51 that extends to the apex of the chamber. A zone of compacted clean fill, gravel or crushed stone extends to an overlying layer such as pavement 53. A street level grated stormwater receptacle, or manhole or other surface access structure may be disposed in a concrete pad 55 centered above top portal means 38. Accumulated sediment 41 is removed by causing a suction tube 40 to pass to the bottom of the accumulating accessory. A vacuuming operation then transports the sediment upwardly into a servicing truck 56. In many instances, the accumulated sediment has dried as a lower cake and a coating upon the walls of compartment 16. In such instances, it is necessary that, prior to the vacuuming operation, a power washing wand be inserted into the compartment to remove the wall coating and to liquefy the lower cake. It is only by virtue of the increased portal diameter of this invention that effective washing and vacuuming can be achieved.

Figure 6:
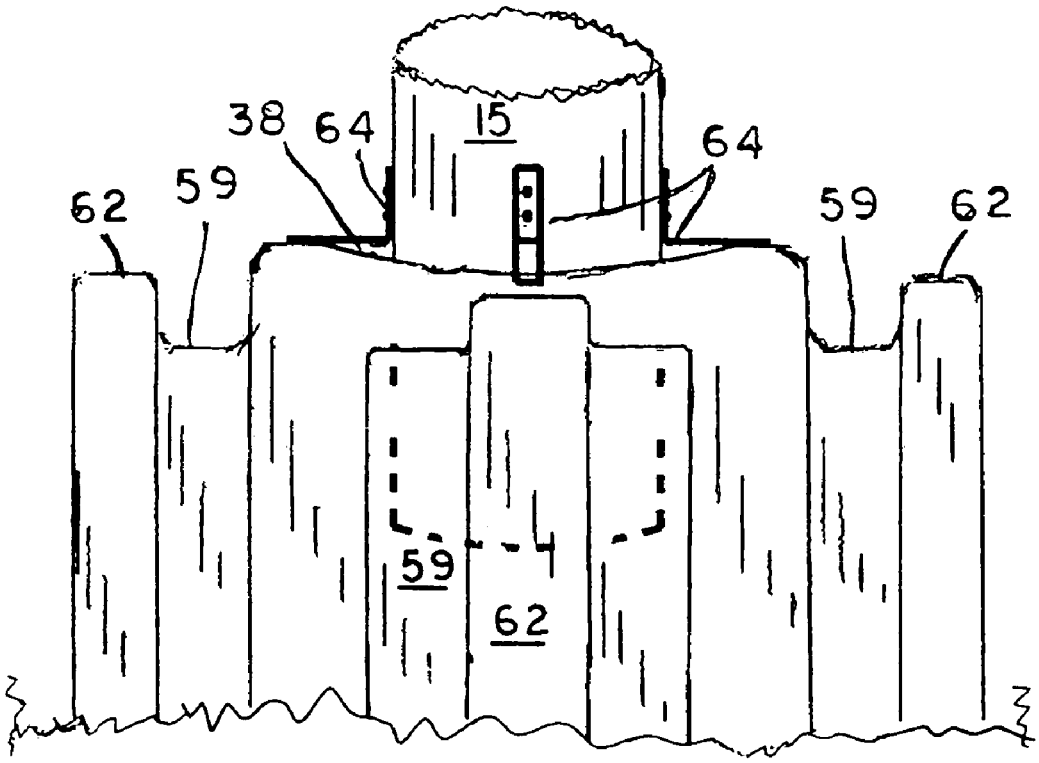
FIG. 6 is an enlarged fragmentary perspective view of FIG. 1.

In a preferred embodiment, riser pipe 15 is provided with positioning means which may be in the form of brackets 64, as shown in FIG. 6. The brackets engage chamber 11 to stabilize engagement therewith.

Figure 7:
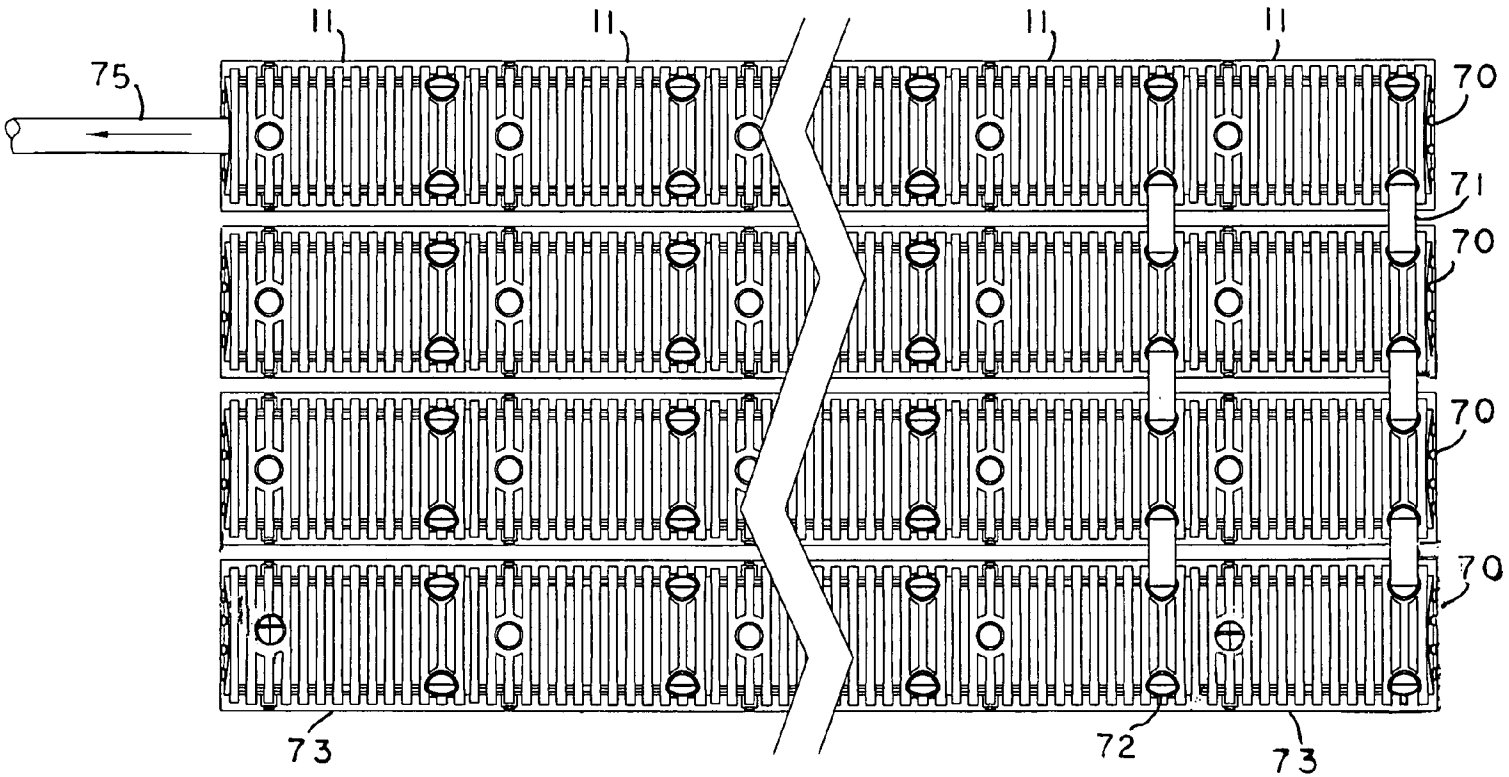
FIG. 7 is a top schematic view of an underground leaching field incorporating the stormwater receiving assembly of FIG. 1.

FIG. 7 illustrates an embodiment of an underground leaching field employing the stormwater receiving assembly of this invention. The parallel rows 70 of interengaged chambers 11 communicate laterally by transverse conduits 71 interactive with side portal means 72 in said chambers. Only two of the illustrated chambers, marked with an "X", and designated by numeral 73, are equipped as stormwater receiving assemblies of this invention. Stormwater is fed into chambers 73 from street-level receptacles, and optionally leaves the field by out-fall conduit 75.

As described hereabove, the several features of this invention, namely:

a) top portal means of exceptionally large diameter,
b) a riser pipe which enters the chamber through said portal means,
c) positioning of the top portal means below a street level grated stormwater receptacle, and
d) joinder of the top of the riser pipe to said stormwater receptacle, permit clean-out of accumulated sediment by way of washing, and vacuuming using an extension tube, and enable stormwater to directly enter the underground assembly of leaching chambers from conventional street level receptacles.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A stormwater receiving assembly comprised of a dispensing chamber disposed below ground level and comprised of a plastic wall horizontally elongated between inlet and exit ends and having an arched cross-sectional shape with upwardly directed apex and spaced apart parallel lowermost edge extremities defining an open bottom, said apex having portal means defined by a substantially circular perimeter having an effective diameter between 11 and 14 inches, an accumulating accessory located below said edge extremities and centered below said portal means, and a rigid riser pipe of circular cylindrical contour that passes through said portal means and extends vertically between a top extremity adjacent said ground level and a bottom extremity located within said chamber.

2. The stormwater receiving assembly of claim 1 wherein said plastic wall is comprised of a succession of parallel corrugations defined by peaks and intervening valleys.

3. The stormwater receiving assembly of claim 2 wherein the perimeter of said portal means extends in part downwardly from said apex a maximum distance of less than 25% of said effective diameter, said perimeter, at said maximum distance of downward extension, being above valleys contiguous to said portal means.

4. The stormwater receiving assembly of claim 3 further comprised of a street level grated receptacle disposed above said chamber and adapted to feed water into the top extremity of said riser pipe.

5. The stormwater receiving assembly of claim 2 wherein said portal means is centered in said apex at a site along the horizontal length of said chamber which is within 20% of the distance going from said exit end to said inlet end.

6. The stormwater receiving assembly of claim 3 wherein said chamber has a width, measured horizontally between said lowermost parallel edge extremities, between 50 and 60 inches, a height, measured vertically between said edge extremities and said apex, between 34 and 40 inches, and a wall thickness of 6 to 10 mm contiguous to said portal means.

7. The stormwater receiving assembly of claim 2 wherein said riser pipe is provided with positioning means interactive with said chamber to stabilize engagement therewith.

8. The stormwater receiving assembly of claim 2 wherein said chamber is joined to other like chambers in end to end connectivity to form a row, and a multitude of said rows are arranged in parallel relationship to produce an underground leaching field.

9. The leaching field of claim 8 wherein said rows are interconnected by transverse conduits communicating with at least two chambers of contiguous rows, said communication being in a direction orthogonal to the direction of elongation of said rows.

* * * * *